US011782379B2

(12) United States Patent
Kosuge et al.

(10) Patent No.: US 11,782,379 B2
(45) Date of Patent: Oct. 10, 2023

(54) ROTATING DEVICE, TRANSPORTING DEVICE, AND IMAGE FORMING APPARATUS

(71) Applicant: FUJIFILM Business Innovation Corp., Tokyo (JP)

(72) Inventors: Tomoya Kosuge, Kanagawa (JP); Hiroyuki Tanaka, Kanagawa (JP); Hiroyuki Momiyama, Kanagawa (JP); Kohei Takahashi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/866,557

(22) Filed: Jul. 18, 2022

(65) Prior Publication Data

US 2023/0121244 A1 Apr. 20, 2023

(30) Foreign Application Priority Data

Oct. 20, 2021 (JP) ..... 2021-171824

(51) Int. Cl.

| | |
|---|---|
| ***G03G 15/00*** | (2006.01) |
| ***G03G 21/16*** | (2006.01) |
| ***B65H 15/00*** | (2006.01) |

(52) U.S. Cl.

CPC ..... *G03G 21/1633* (2013.01); *B65H 15/016* (2020.08); *G03G 15/6529* (2013.01); *G03G 21/1638* (2013.01); *G03G 21/1695* (2013.01); *B65H 2402/441* (2013.01); *B65H 2601/11* (2013.01)

(58) Field of Classification Search

CPC ..... G03G 15/6529; G03G 15/6573; G03G 15/6579; G03G 21/1633; G03G 21/1638; G03G 21/1695; G03G 2221/1675; B65H 15/016; B65H 2402/441; B65H 2601/11

See application file for complete search history.

(56) References Cited

U.S. PATENT DOCUMENTS

| | | | | |
|---|---|---|---|---|
| 8,025,392 | B2 * | 9/2011 | Yamamoto | G03G 21/1638 399/98 |
| 2020/0255250 | A1 * | 8/2020 | Arai | G03G 15/6529 |
| 2022/0306412 | A1 * | 9/2022 | Mori | B65H 5/36 |

FOREIGN PATENT DOCUMENTS

| | | |
|---|---|---|
| JP | 2007197105 | 8/2007 |

* cited by examiner

*Primary Examiner* — Sophia S Chen

(74) *Attorney, Agent, or Firm* — JCIPRNET

(57) ABSTRACT

A rotating device includes: an opening-closing portion supported so as to be openable and closable with respect to a support body; a drive unit provided on the support body; a first rotating body provided on the support body and rotated by a drive force of the drive unit; a driven portion provided in the opening-closing portion; a second rotating body provided in the opening-closing portion, rotated by a transmitted rotational force, and transmitting the rotational force to the driven portion; and an annular body formed in an annular shape, wound around the first rotating body and the second rotating body, maintaining the winding state in both an open state and a closed state of the opening-closing portion, and transmitting the rotational force of the first rotating body to the second rotating body.

20 Claims, 11 Drawing Sheets

ROTATING DEVICE, TRANSPORTING DEVICE, AND IMAGE FORMING APPARATUS

CROSS-REFERENCE TO RELATED APPLICATIONS

This application is based on and claims priority under 35 USC 119 from Japanese Patent Application No. 2021-171824 filed Oct. 20, 2021.

BACKGROUND

(i) Technical Field

The present invention relates to a rotating device, a transporting device, and an image forming apparatus.

(ii) Related Art

JP2007-197105A discloses an image forming apparatus including an image forming apparatus main body, a main transport path provided in the image forming apparatus main body to transport a sheet on which an image is formed, a discharge path connected to the main transport path and discharging the sheet, a switchback transport path connected above the main transport path and switching back the sheet, and a resupply path provided in the image forming apparatus main body, connected to the switchback transport path, and resupplying the switched-back sheet.

SUMMARY

In a rotating device including an opening-closing portion supported so as to be openable and closable with respect to a support body, a drive unit provided on the support body, a driven portion provided in the opening-closing portion, and a gear train transmitting the drive force of the drive unit to the driven portion, the drive transmission path by the gear train is divided when the opening-closing portion is opened, and thus a mechanism that meshes gears when the opening-closing portion is closed is required. Accordingly, the rotating device may become large.

Aspects of non-limiting embodiments of the present disclosure relate to a rotating device, a transporting device, and an image forming apparatus in which an increase in the size of a rotating device is suppressed as compared with a case where a drive transmission path is divided when an opening-closing portion is opened.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a rotating device includes: an opening-closing portion supported so as to be openable and closable with respect to a support body; a drive unit provided on the support body; a first rotating body provided on the support body and rotated by a drive force of the drive unit; a driven portion provided in the opening-closing portion; a second rotating body provided in the opening-closing portion, rotated by a transmitted rotational force, and transmitting the rotational force to the driven portion; and an annular body formed in an annular shape, wound around the first rotating body and the second rotating body, maintaining the winding state in both an open state and a closed state of the opening-closing portion, and transmitting the rotational force of the first rotating body to the second rotating body.

BRIEF DESCRIPTION OF THE DRAWINGS

Exemplary embodiment(s) of the present invention will be described in detail based on the following figures, wherein.

DETAILED DESCRIPTION

Hereinafter, an example of an embodiment according to the present invention will be described with reference to the drawings.

Image Forming Apparatus 10

Figure 1:
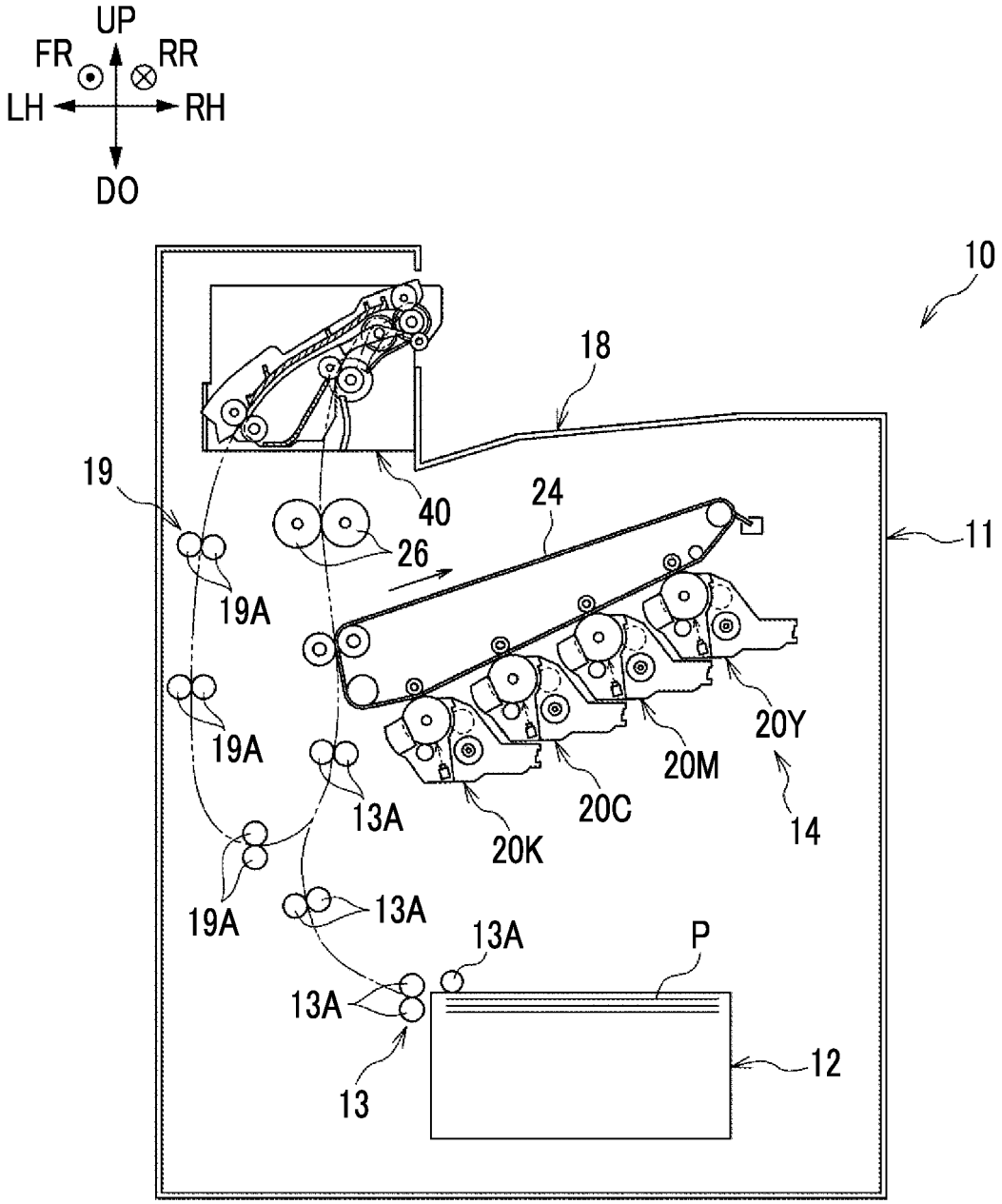
FIG. 1 is a schematic diagram illustrating the configuration of an image forming apparatus according to the present exemplary embodiment.

The configuration of an image forming apparatus 10 according to the present exemplary embodiment will be described. FIG. 1 is a schematic diagram illustrating the configuration of the image forming apparatus 10 according to the present exemplary embodiment.

The arrow UP in the drawings indicates the upper side of the apparatus (specifically, the vertically upper side), and the arrow DO indicates the lower side of the apparatus (specifically, the vertically lower side). In addition, the arrow LH in the drawings indicates the left side of the apparatus, and the arrow RH indicates the right side of the apparatus. In addition, the arrow FR in the drawings indicates the front of the apparatus, and the arrow RR indicates the rear of the apparatus. These directions are for convenience of description, and the apparatus configuration is not limited to these directions. The word "apparatus" may be omitted in each direction of the apparatus. In other words, for example, "upper side of the apparatus" may be simply referred to as "upper side".

The up-down direction, the left-right direction, and the front-rear direction are mutually intersecting directions (specifically, orthogonal directions). In addition, it can be said that the up-down direction is a longitudinal direction. In addition, it can be said that the left-right direction and the front-rear direction are lateral and horizontal directions. In addition, the "X" symbol surrounded by "O" in the drawings means an arrow from the front to the back of the paper. In addition, the "dot" symbol surrounded by "O" in the drawings means an arrow from the back to the front of the paper.

The image forming apparatus 10 illustrated in FIG. 1 is an apparatus that forms an image. Specifically, as illustrated in FIG. 1, the image forming apparatus 10 includes an image forming apparatus main body 11, an accommodating portion 12, a discharge portion 18, a first transporting device 13, an image forming unit 14, a second transporting device 40, and a third transporting device 19. Hereinafter, each part of the image forming apparatus 10 will be described.

Image Forming Apparatus Main Body 11

As illustrated in FIG. 1, the image forming apparatus main body 11 is a part provided with each configuration portion in the image forming apparatus 10. Specifically, for example, the accommodating portion 12, the first transporting device 13, the image forming unit 14, the second transporting device 40, and the third transporting device 19 are disposed in the image forming apparatus main body 11.

Accommodating Portion 12

The accommodating portion 12 is a part in the image forming apparatus 10 that accommodates a recording medium P. The recording medium P accommodated in the accommodating portion 12 is supplied to the image forming unit 14. The recording medium P accommodated in the accommodating portion 12 is an example of a material to be transported and is an object of image formation by the image forming unit 14. Examples of the recording medium P include paper and a film. Examples of the film include a resin film and a metal film. The recording medium P is not limited to the above, and various recording media can be used.

Discharge Portion 18

The discharge portion 18 is a part where the recording medium P is discharged in the image forming apparatus 10. The recording medium P is discharged to the discharge portion 18 with an image formed by the image forming unit 14.

First Transporting Device 13

The first transporting device 13 is a device that transports the recording medium P accommodated in the accommodating portion 12 toward the image forming unit 14. Specifically, as illustrated in FIG. 1, the first transporting device 13 has transport members 13A such as a plurality of transport rolls, and the recording medium P is transported by the transport member 13A.

Image Forming Unit 14

The image forming unit 14 has a function of forming an image on the recording medium P transported by the first transporting device 13. Specifically, the image forming unit 14 forms a toner image (an example of an image) on the recording medium P by an electrophotographic method. More specifically, as illustrated in FIG. 1, the image forming unit 14 has toner image forming units 20Y, 20M, 20C, and 20K (hereinafter, referred to as 20Y to 20K), a transfer body 24, and a fixing unit 26.

In the image forming unit 14, each of the toner image forming units 20Y to 20K performs the processes of charging, exposure, development, and transfer, and yellow (Y), magenta (M), cyan (C), and black (K) toner images are formed on the transfer body 24. Further, the image forming unit 14 transfers the toner image of each color formed on the transfer body 24 to the recording medium P, and the toner image is fixed to the recording medium P by the fixing unit 26. In this manner, the image forming unit 14 uses an intermediate transfer method for transferring an image to the recording medium P via the transfer body 24.

Second Transporting Device 40

Figure 6:
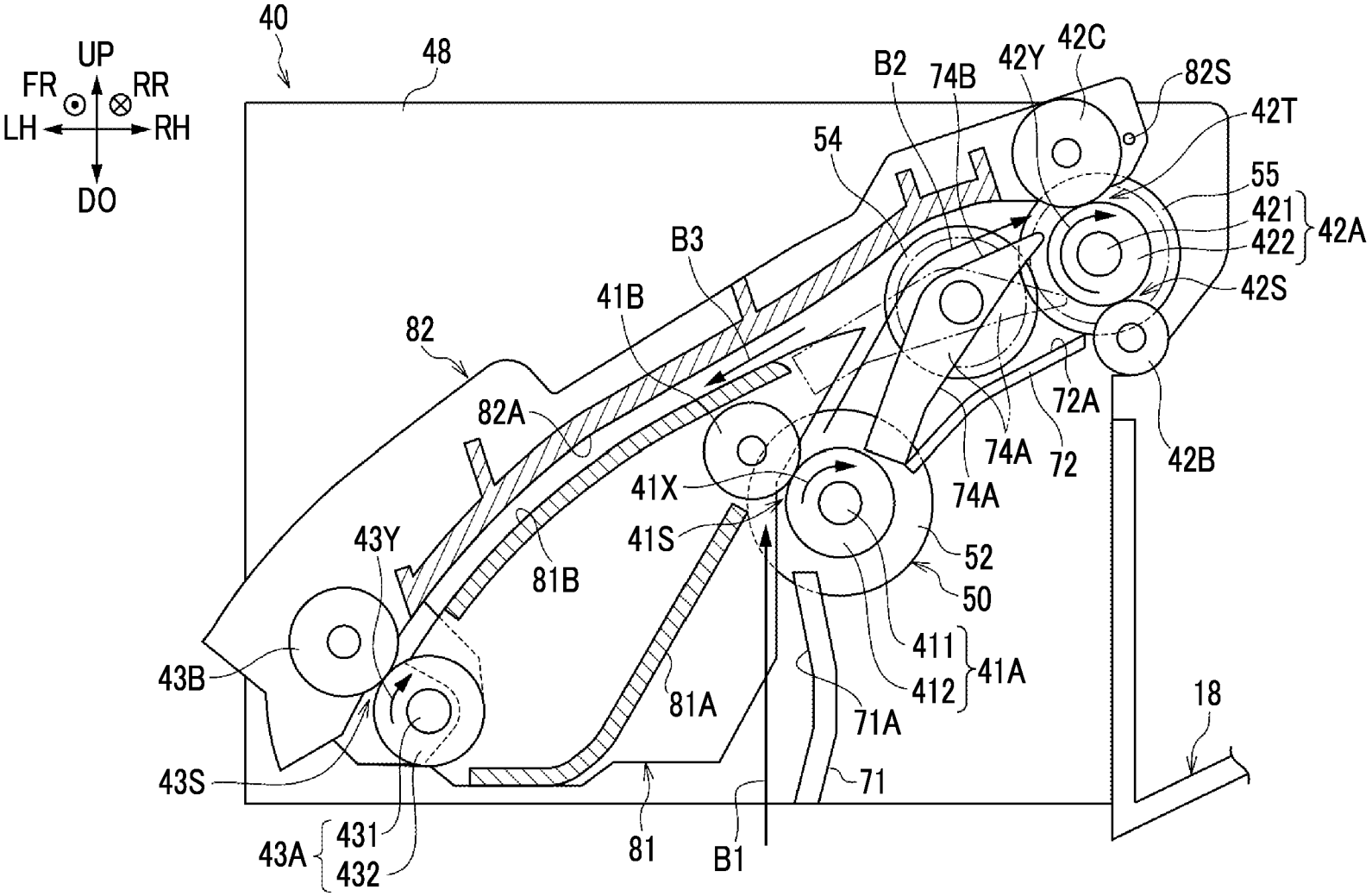
FIG. 6 is a front cross-sectional view of the second transporting device according to the present exemplary embodiment.

The second transporting device 40 is an example of a rotating device and a transporting device and is a device that transports the recording medium P with an image formed by the image forming unit 14. Specifically, the second transporting device 40 discharges the recording medium P on which an image is formed by the image forming unit 14 to the discharge portion 18 or inverts the recording medium P on which an image is formed by the image forming unit 14. In other words, the second transporting device 40 selectively transports the recording medium P on which an image is formed by the image forming unit 14 through one of a discharge path for discharge to the discharge portion 18 and an inversion path for inversion. The discharge path is indicated by the arrows A1, A2, and A3 in FIG. 2. In FIG. 6, the inversion path is configured by a first inversion path indicated by the arrows B1 and B2 and a second inversion path indicated by the arrow B3. In other words, in the second transporting device 40, the recording medium P transported through the first inversion path is transported through the first inversion path and then switched back to be transported through the second inversion path. A specific configuration of the second transporting device 40 will be described later.

Third Transporting Device 19

The third transporting device 19 is a device that transports the recording medium P inverted by the second transporting device 40 toward the image forming unit 14. In other words, the recording medium P inverted by the second transporting device 40 is transported to the image forming unit 14 again. Specifically, as illustrated in FIG. 1, the third transporting device 19 has transport members 19A such as a plurality of transport rolls, and the recording medium P is transported by the transport member 19A.

Specific Configuration of Second Transporting Device 40

Figure 2:
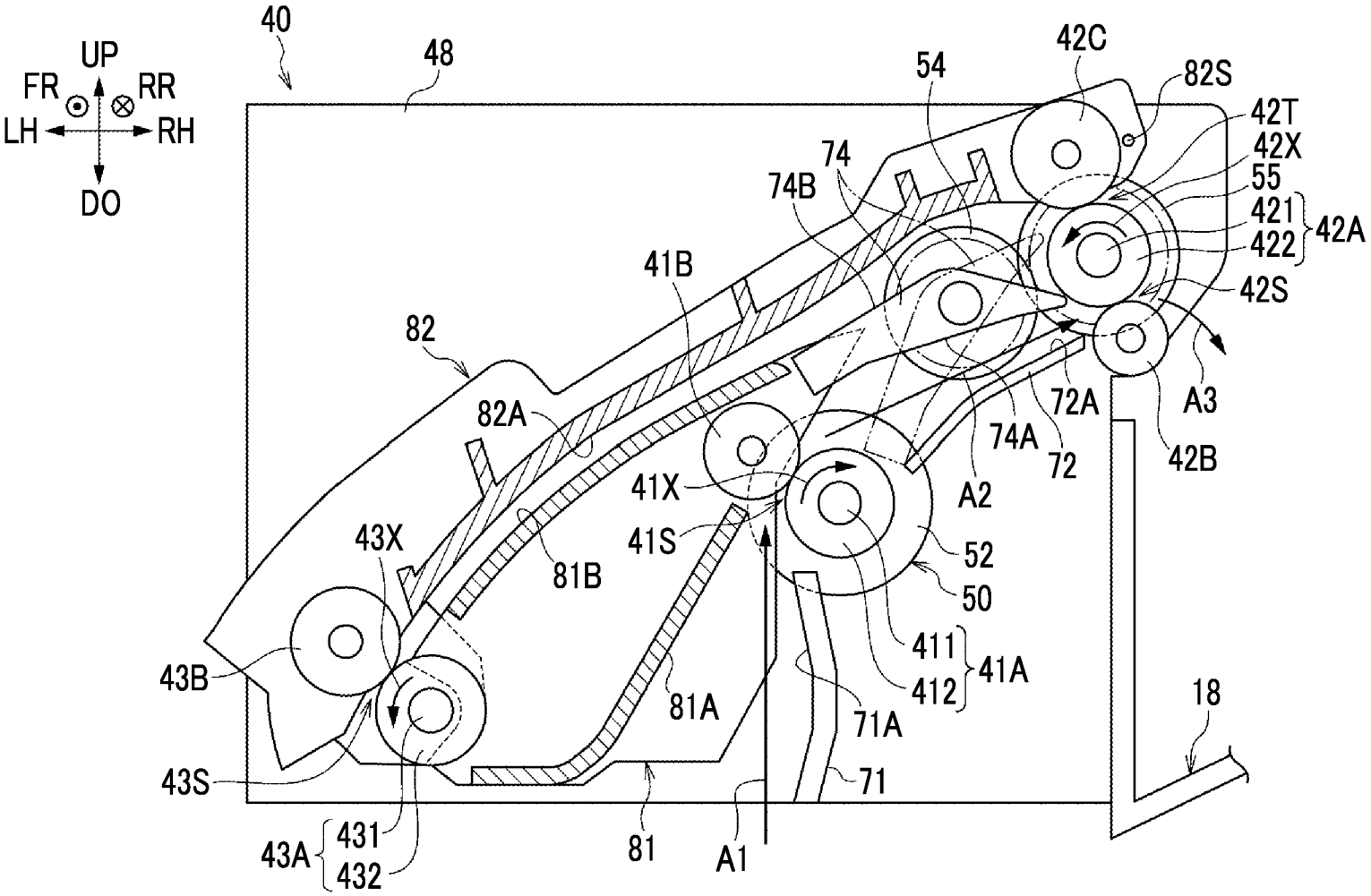
FIG. 2 is a front cross-sectional view of a second transporting device according to the present exemplary embodiment.
Figure 3:
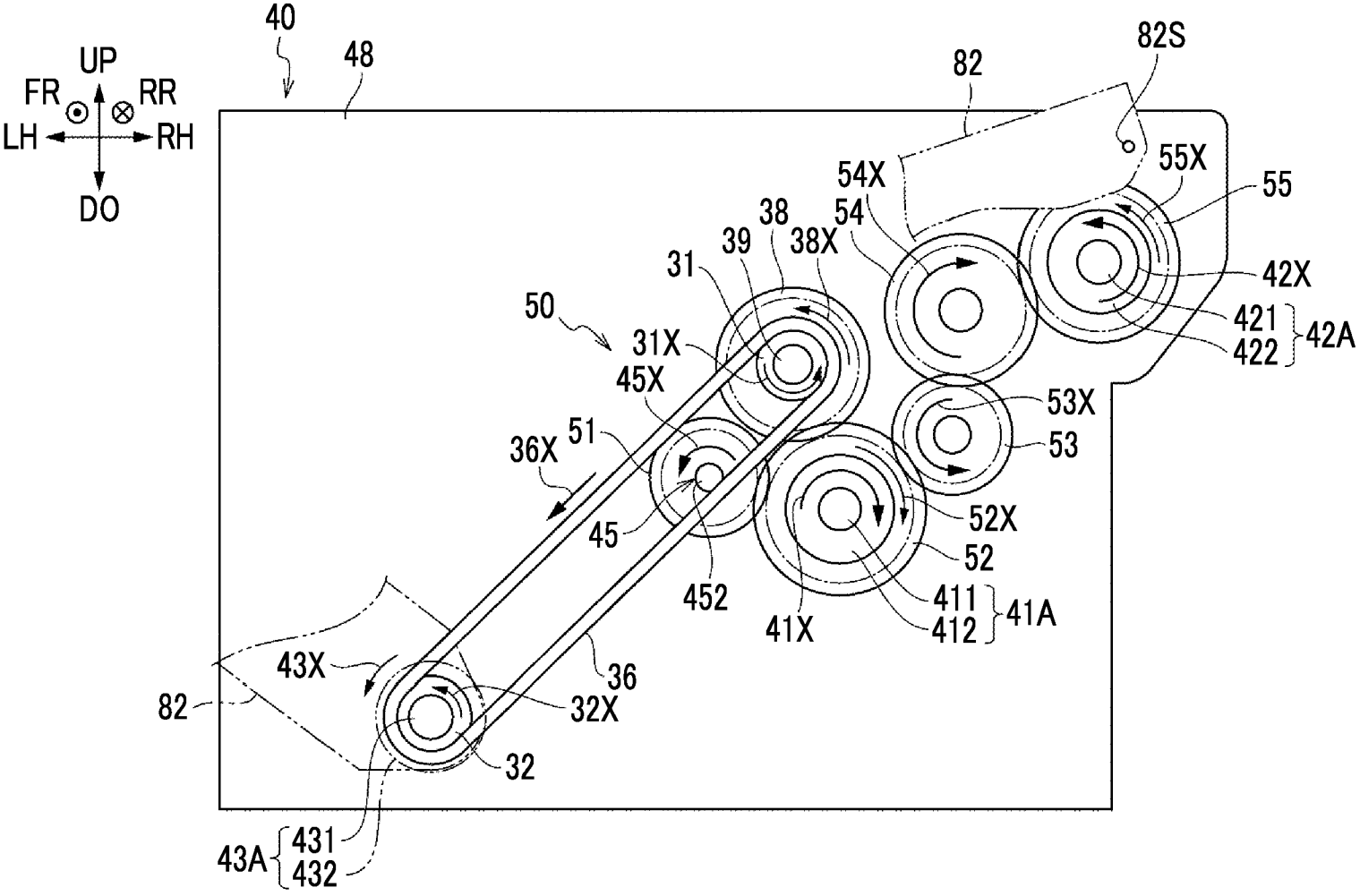
FIG. 3 is a front view illustrating a part of a transmission mechanism in the second transporting device according to the present exemplary embodiment.
Figure 4:
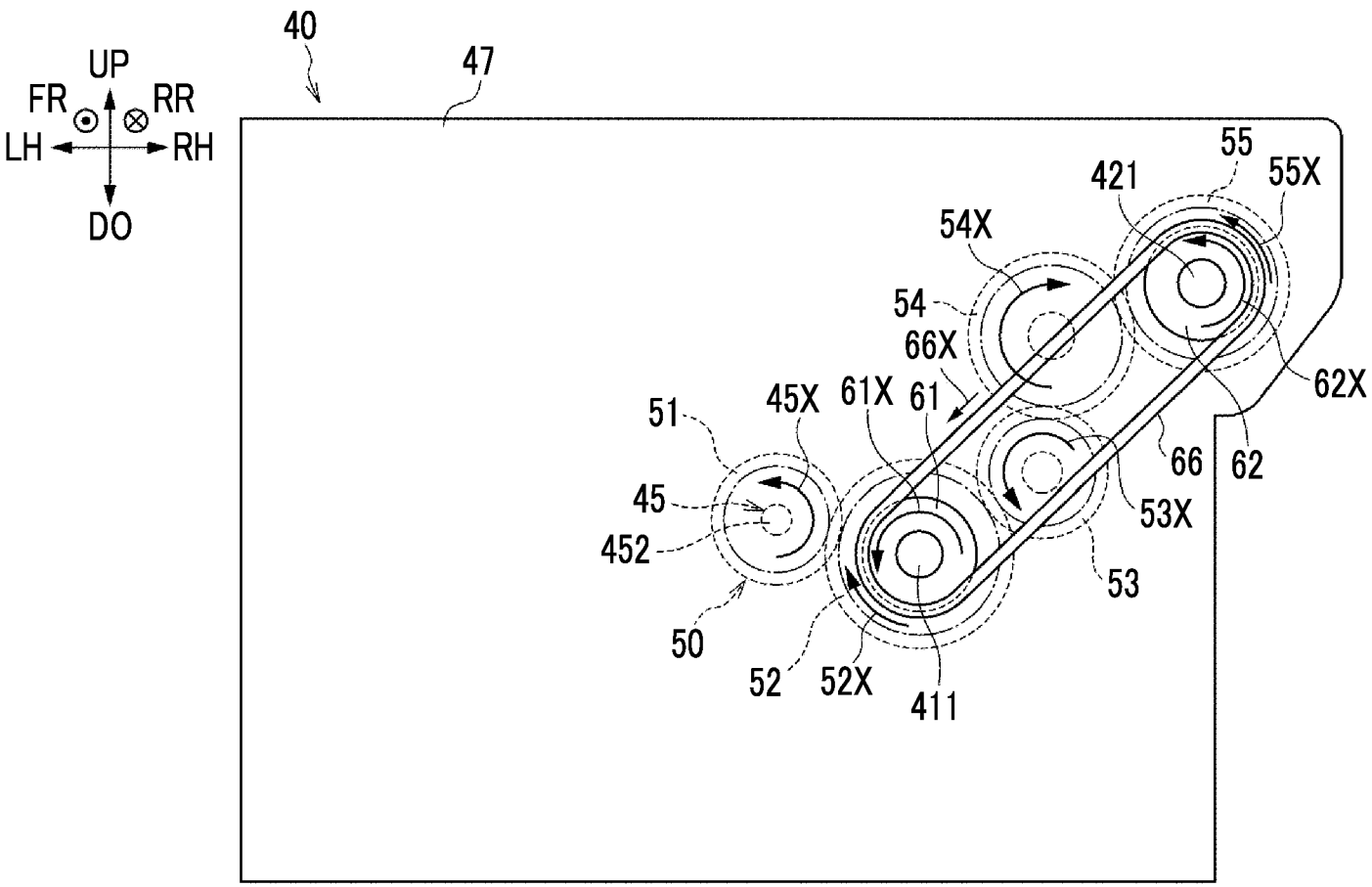
FIG. 4 is a front view illustrating a part of the transmission mechanism in the second transporting device according to the present exemplary embodiment.
Figure 5:
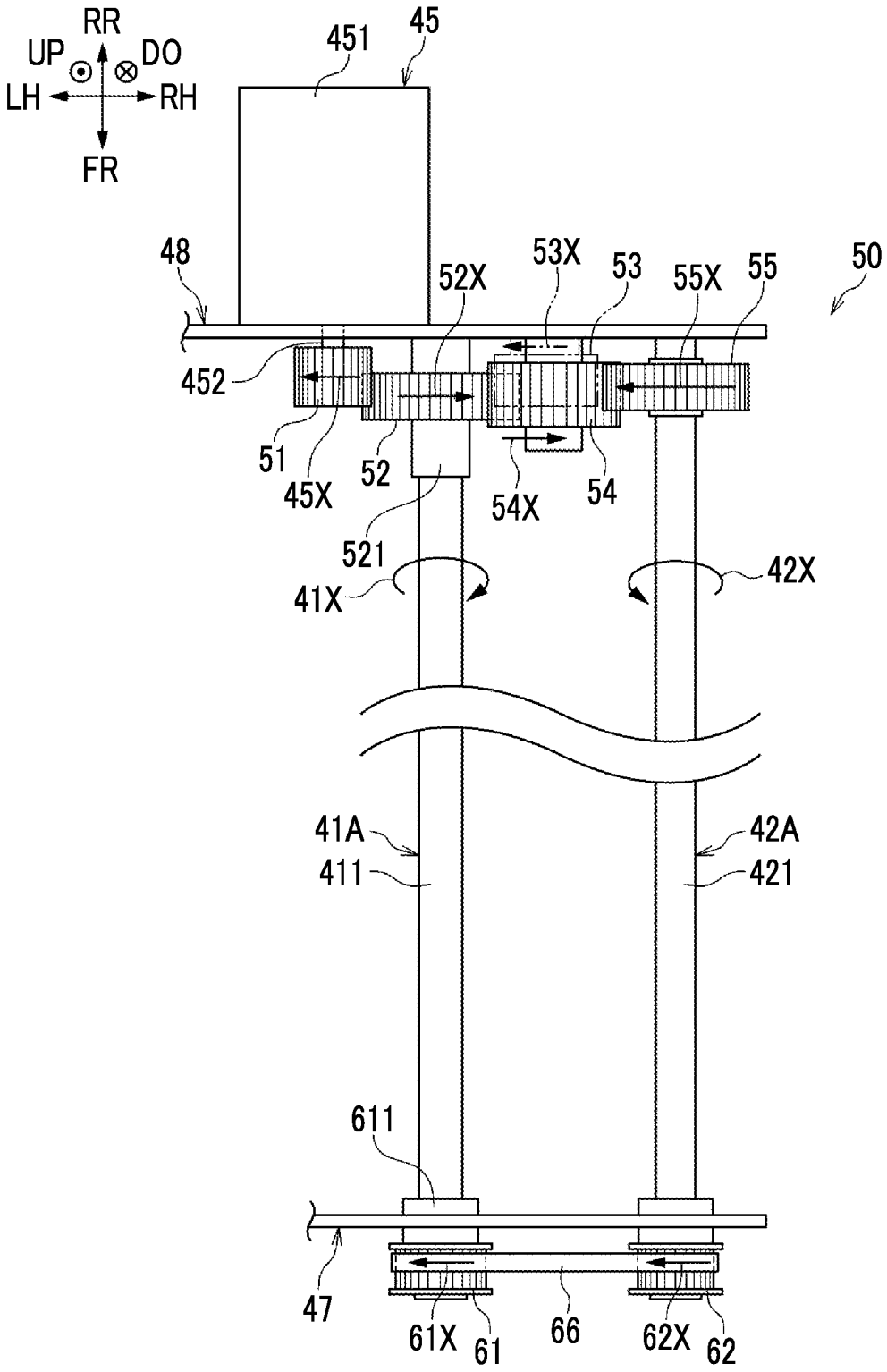
FIG. 5 is a plan view of the second transporting device according to the present exemplary embodiment.
Figure 7:
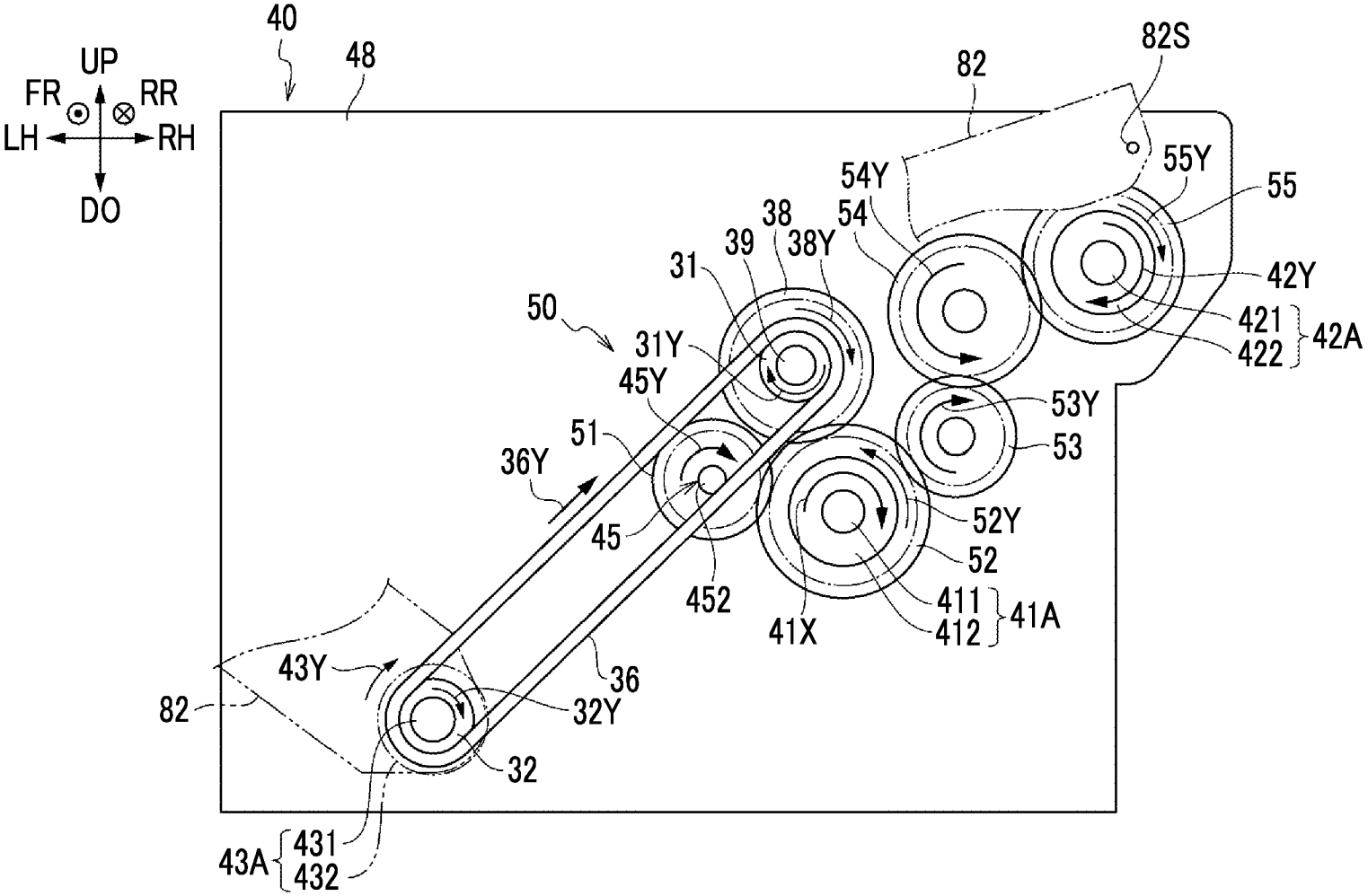
FIG. 7 is a front view illustrating a part of the transmission mechanism in the second transporting device according to the present exemplary embodiment.
Figure 8:
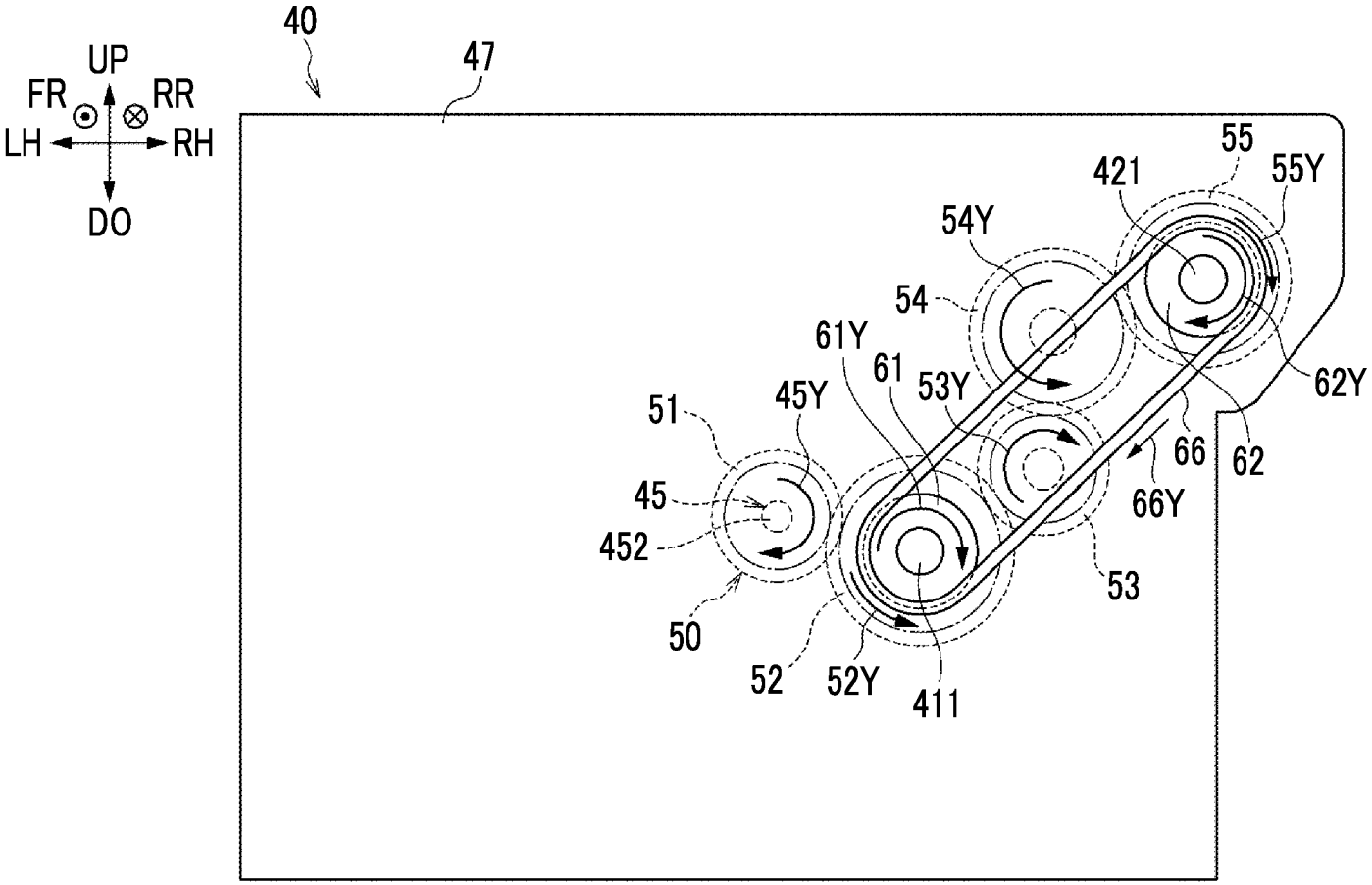
FIG. 8 is a front view illustrating a part of the transmission mechanism in the second transporting device according to the present exemplary embodiment.
Figure 9:
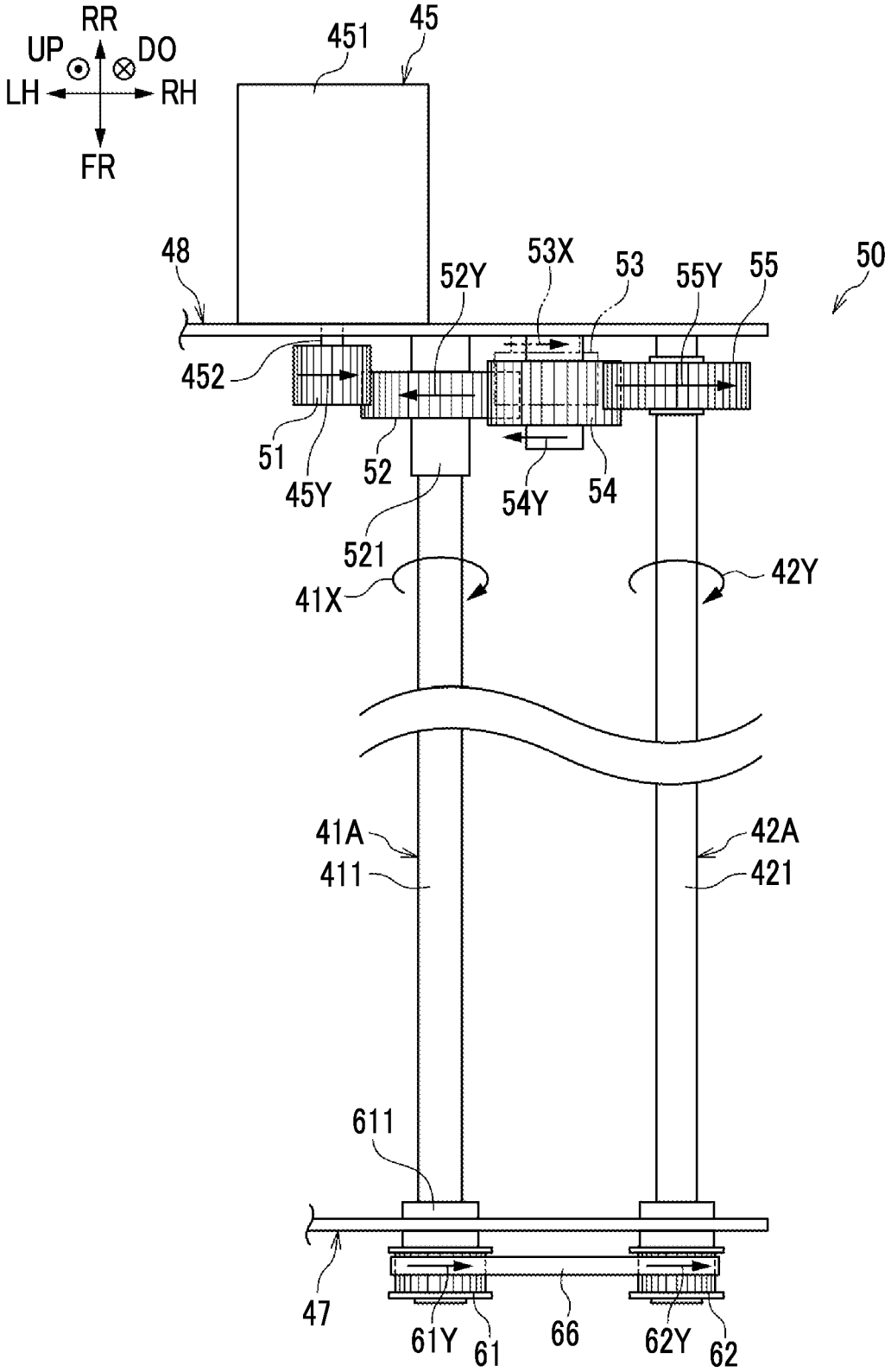
FIG. 9 is a plan view of the second transporting device according to the present exemplary embodiment.

A specific configuration of the second transporting device 40 will be described. FIGS. 2 and 6 are front cross-sectional views of the second transporting device 40. FIGS. 3 and 7 are front views illustrating a part of a transmission mechanism 50 (described later) in the second transporting device 40. FIGS. 4 and 8 are front views illustrating the transmission mechanism 50 (described later) in the second transporting device 40. FIGS. 5 and 9 are plan views of the second transporting device 40.

Figure 10:
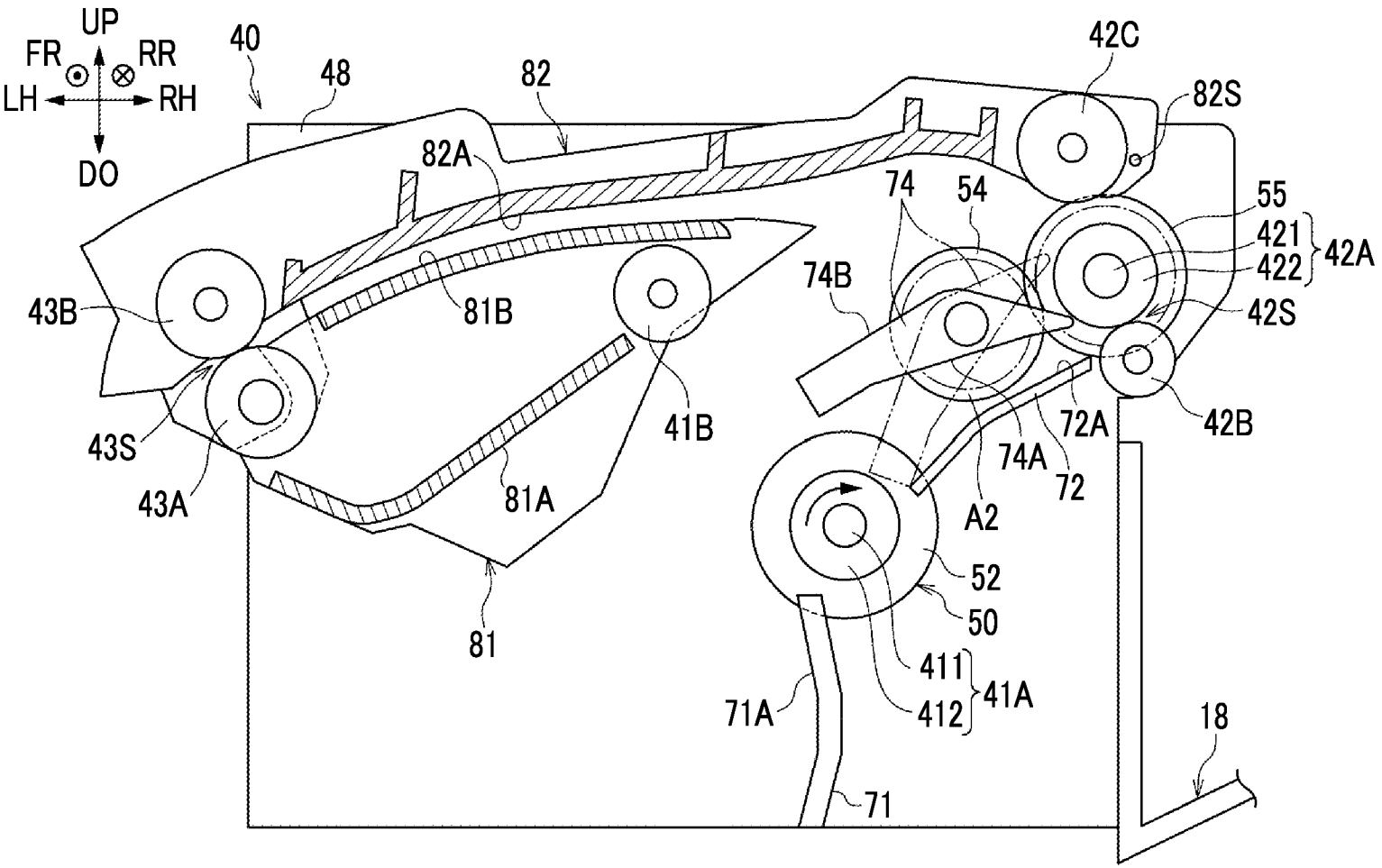
FIG. 10 is a front cross-sectional view illustrating a state where an opening-closing body in the second transporting device according to the present exemplary embodiment is open.
Figure 11:
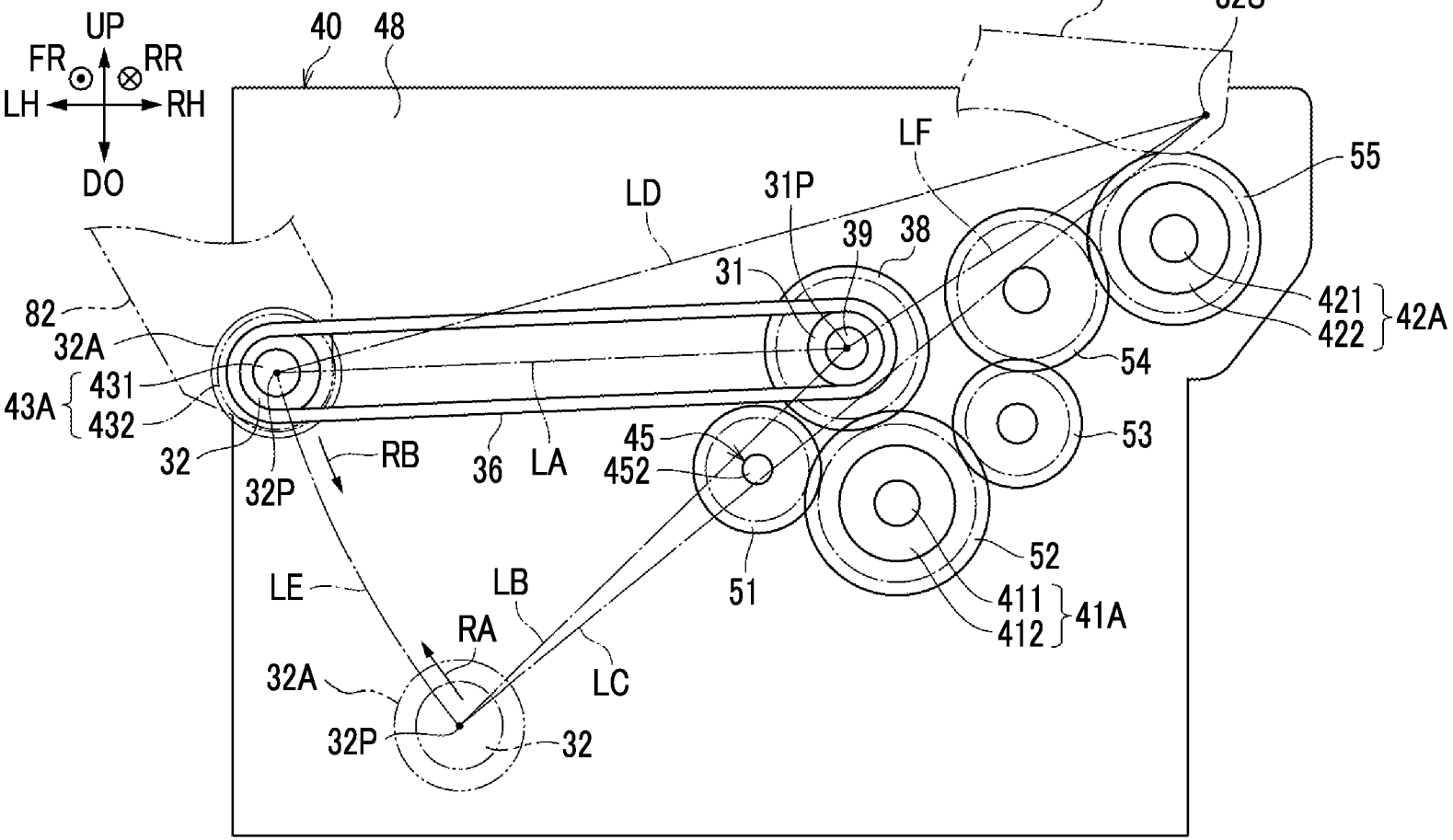
FIG. 11 is a front view illustrating the transmission mechanism in the state where the opening-closing body in the second transporting device according to the present exemplary embodiment is open.

FIGS. 2, 3, 4, and 5 illustrate the second transporting device 40 in a case where the recording medium P is discharged to the discharge portion 18. On the other hand, FIGS. 6, 7, 8, and 9 illustrate the second transporting device 40 in a case where the recording medium P is inverted. In addition, FIG. 10 is a front cross-sectional view illustrating a state where opening-closing bodies 81 and 82 (described later) in the second transporting device 40 are open. In addition, FIG. 11 is a front view illustrating the transmission mechanism 50 (described later) in a state where the opening-closing bodies 81 and 82 in the second transporting device 40 are open.

As illustrated in FIGS. 2, 3, 4, and 5, the second transporting device 40 includes support frames 47 and 48, drive rolls 41A, 42A, and 43A, driven rolls 41B, 42B, 42C, and 43B, a drive motor 45, the transmission mechanism 50, guides 71, 72, and 74, and the opening-closing bodies 81 and 82.

Support Frames 47 and 48

The support frames 47 and 48 illustrated in FIG. 5 and the like are examples of a support body and have a function of supporting each configuration portion of the second transporting device 40 including the opening-closing bodies 81 and 82, the drive rolls 41A and 42A, the drive motor 45, and the transmission mechanism 50. As illustrated in FIG. 5, the support frames 47 and 48 are formed in, for example, a plate shape in which the front-rear direction is the thickness direction.

The support frame 47 constitutes a front side part in the second transporting device 40 and is disposed on the front side with respect to the support frame 48. The support frame 48 constitutes a rear side part in the second transporting device 40 and is disposed on the rear side with respect to the support frame 47.

Opening-Closing Bodies 81 and 82

The opening-closing bodies 81 and 82 are examples of an opening-closing portion and are supported so as to be openable and closable with respect to the support frames 47 and 48. The opening-closing bodies 81 and 82 move relative to the support frames 47 and 48 including the drive motor 45 and the drive rolls 41A and 42A to open and close.

Specifically, the opening-closing bodies 81 and 82 are opened and closed to the closed position illustrated in FIG. 2 and the closed open position illustrated in FIG. 10 by integrally rotating the other end side (specifically, the left end side) with one end side (specifically, the right end side of the opening-closing body 82) as a fulcrum. In FIGS. 2, 6, and 10, the rotating shaft (fulcrum) of the opening-closing bodies 81 and 82 is indicated by reference numeral 82S. In addition, hereinafter, the state where the opening-closing bodies 81 and 82 are positioned at the open position will be referred to as the open state of the opening-closing bodies 81 and 82, and the state where the opening-closing bodies 81 and 82 are positioned at the closed position will be referred to as the closed state of the opening-closing bodies 81 and 82.

"Opening the opening-closing bodies 81 and 82" means that the opening-closing bodies 81 and 82 are moved relative to the support frames 47 and 48 and predetermined parts of the opening-closing bodies 81 and 82 become far from the parts of the support frames 47 and 48 or the members provided in the support frames 47 and 48. Further, the parts of the support frames 47 and 48 or the members provided in the support frames 47 and 48 may be exposed by the predetermined parts of the opening-closing bodies 81 and 82 becoming far from the parts of the support frames 47 and 48 or the members provided in the support frames 47 and 48.

In the present exemplary embodiment, as illustrated in FIG. 10, the opening-closing bodies 81 and 82 become far from the drive roll 41A and the guide 71 provided in the support frames 47 and 48 by being opened. Further, a roll portion 412 of the drive roll 41A and a guide surface 71A of the guide 71 are exposed by the opening-closing bodies 81 and 82 being opened.

In addition, in the present exemplary embodiment, the opening-closing bodies 81 and 82 have a function of guiding the recording medium P. The opening-closing body 81 is disposed on the left side with respect to the drive roll 41A in the closed state. The opening-closing body 81 has a guide surface 81A facing the guide 71 and a guide surface 81B facing the opening-closing body 82 side (the diagonally upper left side in FIG. 2) in the closed state. In the opening-closing body 81, the recording medium P is guided toward the downstream side in the transport direction (specifically, a contact region 41S of the drive roll 41A) by coming into contact with the guide surface 81A. In addition, in the opening-closing body 81, the recording medium P is guided toward the downstream side in the transport direction (specifically, a contact region 43S of the drive roll 43A) by coming into contact with the guide surface 81B. The guide surface 81A and the guide surface 81B are examples of a guide portion. Further, the driven roll 41B is rotatably supported by the opening-closing body 81, and the driven roll 41B moves integrally with the opening-closing body 81.

The opening-closing body 82 is disposed on the upper side with respect to the opening-closing body 81, the guide 74, and the drive roll 42A. The opening-closing body 82 has a guide surface 82A facing the guide surface 81B of the opening-closing body 81. In the opening-closing body 82, the recording medium P is guided toward the downstream side in the transport direction (specifically, the contact region 43S of the drive roll 43A) by coming into contact with the guide surface 82A. Further, the driven roll 42C is rotatably supported in one end portion (specifically, the right end portion) of the opening-closing body 82, and the driven roll 42C moves integrally with the opening-closing body 82. In addition, the drive roll 43A and the driven roll 43B are rotatably supported in the other end portion (specifically, the left end portion) of the opening-closing body 82, and the drive roll 43A and the driven roll 43B move integrally with the opening-closing body 82. The guide surface 82A is an example of a guide portion.

In a case where, for example, the discharge path (see the arrows A1 and A2 in FIG. 2) and the inversion path (see the arrows B1, B2, and B3 in FIG. 6) are clogged with the recording medium P (so-called jam), the opening-closing bodies 81 and 82 are opened and closed so that the clogging is eliminated. In addition, the opening and closing of the opening-closing bodies 81 and 82 are performed in, for example, a state where an exterior cover (not illustrated) provided on the image forming apparatus main body 11 and covering the opening-closing bodies 81 and 82 is open.

Drive Rolls 41A, 42A, and 43A and Driven Rolls 41B, 42B, 42C, and 43B The drive rolls 41A, 42A, and 43A illustrated in FIG. 2 and the like are transport rolls that are rotationally driven by the drive motor 45 (see FIG. 5). Specifically, as illustrated in FIG. 2, the drive rolls 41A, 42A, and 43A have shaft portions 411, 421, and 431 and roll portions 412, 422, and 432 provided on the outer circumferences of the shaft portions 411, 421, and 431. As illustrated in FIG. 5, the drive rolls 41A and 42A have one and the other end portions (specifically, front and rear end portions) rotatably supported on the respective support frames 47 and 48 by the shaft portions 411 and 421. In FIG. 5, the drive rolls 41A and 42A are illustrated without the roll portions 412 and 422 being illustrated.

As illustrated in FIG. 2, the drive roll 41A has the contact region 41S of contact with the driven roll 41B. By coming into contact with the drive roll 41A in the contact region 41S, the driven roll 41B is driven by the drive roll 41A and rotates. The driven roll 41B is rotatably supported by the opening-closing body 81.

The drive roll 41A and the driven roll 41B are disposed on the downstream side in the transport direction with respect to the image forming unit 14 (specifically, the fixing unit 26)

illustrated in FIG. 1. Further, by the drive roll 41A rotating in the forward direction (rotation in the arrow 41X direction), the drive roll 41A and the driven roll 41B transport the recording medium P transported from the image forming unit 14 (specifically, the fixing unit 26) toward the downstream side in the transport direction (specifically, the drive roll 42A) while sandwiching the recording medium P in the contact region 41S. As will be described later, the drive roll 41A rotates in the forward direction by the drive force of the drive motor 45 being transmitted by the transmission mechanism 50.

The driven roll 42B is disposed on one side (specifically, the lower side) with respect to the drive roll 42A. The driven roll 42B is rotatably supported by the support frames 47 and 48. The driven roll 42C is disposed on the side opposite to the driven roll 42B side (specifically, the upper side) with respect to the drive roll 42A. The driven roll 42C is rotatably supported by the opening-closing body 82.

The drive roll 42A has contact regions 42S and 42T of contact with the driven rolls 42B and 42C. By coming into contact with the drive roll 42A in the contact regions 42S and 42T, the driven rolls 42B and 42C are driven by the drive roll 42A and rotate. The drive roll 42A and the driven rolls 42B and 42C are disposed on the downstream side in the transport direction with respect to the drive roll 41A and the driven roll 41B.

Further, as illustrated in FIG. 2, by the drive roll 42A rotating in the forward direction (rotation in the arrow 42X direction), the drive roll 42A and the driven roll 42B discharge the recording medium P to the discharge portion 18 through the discharge path (see the arrows A2 and A3) while sandwiching the recording medium P in the contact region 42S. At this time, the guide 74 is positioned at the discharge position (the position indicated by a solid line in FIG. 2).

In addition, in a case where the recording medium P transported from the drive roll 41A and the driven roll 41B is inverted, the drive roll 42A rotates in the reverse direction (rotation in the arrow 42Y direction) as illustrated in FIG. 6, and then the drive roll 42A and the driven roll 42C transport the recording medium P through the first inversion path (see the arrow B2) while sandwiching the recording medium P in the contact region 42T. At this time, the guide 74 is positioned at the inversion position (the position indicated by a solid line in FIG. 6).

Subsequently, by the drive roll 42A rotating in the forward direction, the drive roll 42A and the driven roll 42C transport the recording medium P through the second inversion path (see the arrow B3). At this time, the guide 74 is positioned at the discharge position (the position indicated by a two-dot chain line in FIG. 6). In this manner, the drive roll 42A and the driven roll 42C invert the recording medium P by the drive roll 42A rotating in the forward direction after rotating in the reverse direction. As will be described later, the drive roll 42A rotates in the forward and reverse directions by the drive force of the drive motor 45 being transmitted by the transmission mechanism 50.

The drive roll 43A is an example of a driven portion and a transport member and is rotatably supported by the opening-closing body 82. Specifically, as for the drive roll 43A, each of one end portion (specifically, the front end portion) and the other end portion (specifically, the rear end portion) is rotatably supported on the opening-closing body 82 by the shaft portion 431. The drive roll 43A has the contact region 43S of contact with the driven roll 43B.

By coming into contact with the drive roll 43A in the contact region 43S, the driven roll 43B is driven by the drive roll 43A and rotates. The drive roll 43A and the driven roll 43B are disposed on the downstream side in the transport direction with respect to the drive roll 42A and the driven roll 42C. The driven roll 43B is rotatably supported by the opening-closing body 82 as in the case of the drive roll 43A.

Further, by the drive roll 43A rotating in the forward direction (rotation in the arrow 43X direction in FIG. 2), the drive roll 43A and the driven roll 43B transport the recording medium P transported from the drive roll 42A and the driven roll 42C toward the downstream side in the transport direction (specifically, the image forming unit 14) while sandwiching the recording medium P in the contact region 43S. As will be described later, the drive roll 43A rotates in the forward direction by the drive force of the drive motor 45 being transmitted by the transmission mechanism 50.

Guides 71 and 72

The guides 71 and 72 illustrated in FIG. 2 have a function of guiding the recording medium P. As illustrated in FIG. 2, the guide 71 is disposed on the upstream side in the transport direction with respect to the drive roll 41A and on the downstream side in the transport direction with respect to the fixing unit 26. Specifically, the guide 71 is disposed on the lower side with respect to the drive roll 41A. By the recording medium P coming into contact with the guide surface 71A facing the left side in FIG. 2, the guide 71 guides the recording medium P toward the downstream side in the transport direction (specifically, the contact region 41S of the drive roll 41A).

The guide 72 is disposed on the downstream side in the transport direction with respect to the drive roll 41A and on the upstream side in the transport direction with respect to the drive roll 42A. Specifically, in FIG. 2, the guide 72 is disposed on the diagonally upper right side with respect to the drive roll 41A and on the diagonally lower left side with respect to the drive roll 42A. By the recording medium P coming into contact with a guide surface 72A facing the upper side in FIG. 2, the guide 72 guides the recording medium P toward the downstream side in the transport direction (specifically, the contact region 42S of the drive roll 42A).

Guide 74

The guide 74 illustrated in FIG. 2 has a function of guiding the recording medium P. As illustrated in FIG. 2, the guide 74 is disposed on the downstream side in the transport direction with respect to the drive roll 41A and on the upstream side in the transport direction with respect to the drive roll 42A.

The guide 74 is rotatable between the discharge position where the discharge path is formed (the position indicated by a solid line in FIG. 2) and the inversion position where the inversion path is formed (the position indicated by a two-dot chain line in FIG. 2). At the discharge position, the guide 74 forms the discharge path (specifically, the path from the contact region 41S to the contact region 42S (see the arrow A2)) with the guide 72. The guide 74 guides the recording medium P on the guide surface 74A facing the lower side at the discharge position.

At the inversion position, the guide 74 forms the first inversion path (specifically, the path from the contact region 41S to the contact region 42T (see the arrow B2 in FIG. 6)) with the opening-closing bodies 81 and 82. The guide 74 guides the recording medium P on a guide surface 74B facing the left side at the inversion position.

As an example, the guide 74 is configured to be rotated to the discharge position and the inversion position using the drive force of the drive motor 45.

Drive Motor 45 and Transmission Mechanism 50

The drive motor 45 illustrated in FIG. 5 and the like is an example of a drive unit and outputs drive forces in the forward rotation direction (the arrow 45X direction in FIG. 3 and the like) and the reverse rotation direction (the arrow 45Y direction in FIG. 7 and the like). As illustrated in FIG. 5, the drive motor 45 has a main body 451 and a drive shaft 452. The main body 451 is fixed to the support frame 48 on the rear side with respect to the support frame 48. The drive shaft 452 extends from the main body 451 to the front side with respect to the support frame 48. A stepping motor, a DC motor (that is, a direct current motor), or the like can be used as the drive motor 45.

The transmission mechanism 50 illustrated in FIG. 5 and the like is a mechanism that transmits the drive force of the drive motor 45 to the drive rolls 41A, 42A, and 43A. In the present exemplary embodiment, the transmission mechanism 50 transmits the drive force in the forward rotation direction (the arrow 45X direction) output from the drive motor 45 to the drive rolls 41A, 42A, and 43A to rotate the drive rolls 41A, 42A, and 43A in the forward direction. In addition, the transmission mechanism 50 transmits the drive force in the reverse rotation direction (the arrow 45Y direction) output from the drive motor 45 to the drive rolls 41A, 42A, and 43A to rotate the drive roll 41A in the forward direction and rotate the drive rolls 42A and 43A in the reverse direction.

In the present exemplary embodiment, as illustrated in FIGS. 3, 4, and 5, the transmission mechanism 50 has gears 51, 52, 53, 54, 55, and 38, pulleys 61, 62, 31, and 32, timing belts 66 and 36, and one-way clutches 521 and 611 as components. In the transmission mechanism 50, the gears 51, 52, 53, 54, 55, and 38, the one-way clutch 521, the pulleys 31 and 32, and the timing belt 66 are disposed on one axial end side (specifically, the rear end side) of the drive rolls 41A, 42A, and 43A, and the pulleys 61 and 62, the timing belt 66, and the one-way clutch 611 are disposed on the other axial end side (specifically, the front end side) of the drive rolls 41A, 42A, and 43A.

The gear 51 is fixed to the drive shaft 452 of the drive motor 45. The gear 52 meshes with the gear 51 and is fixed to the rear end portion of the shaft portion 411 of the drive roll 41A via the one-way clutch 521. The one-way clutch 521 functions as a transmission unit that transmits the rotational force in the forward rotation direction (the arrow 52X direction in FIG. 3 and the like) of the gear 52 to the shaft portion 411 of the drive roll 41A and does not transmit the rotational force in the reverse rotation direction (the arrow 52Y direction in FIG. 7 and the like) of the gear 52 to the shaft portion 411 of the drive roll 41A.

The gear 53 meshes with the gear 52 and is rotatably supported by the support frame 48. The gear 54 meshes with the gear 53 and is rotatably supported by the support frame 48. The gear 55 meshes with the gear 54 and is fixed to the rear end portion of the shaft portion 421 of the drive roll 42A.

The pulley 61 is fixed to the front end portion of the shaft portion 411 of the drive roll 41A via the one-way clutch 611. The one-way clutch 611 functions as a transmission unit that transmits the rotational force in the reverse rotation direction (the arrow 61Y direction in FIGS. 8, 9, and the like) of the pulley 61 to the shaft portion 411 of the drive roll 41A and does not transmit the rotational force in the forward rotation direction (the arrow 61X direction in FIGS. 4, 5, and the like) of the pulley 61 to the shaft portion 411 of the drive roll 41A.

The pulley 62 is fixed to the front end portion of the shaft portion 421 of the drive roll 42A. The timing belt 66 is formed in an annular shape and is wound around the pulleys 61 and 62. Further, the teeth formed on the inner circumference of the timing belt 66 mesh with the teeth formed on the outer circumferences of the pulleys 61 and 62.

Gear 38, Pulleys 31 and 32, and Timing Belt 36

The gear 38 meshes with the gear 52 and is rotatably supported on the support frame 48 by a rotating shaft 39. The pulley 31 is an example of a first rotating body and is fixed to the rotating shaft 39. In other words, the pulley 31 and the gear 38 are disposed coaxially. The pulley 31 rotates in the forward and reverse directions by the drive forces of the drive motor 45 in the forward rotation direction (the arrow 45X direction) and the reverse rotation direction (the arrow 45Y direction) being transmitted via the gears 51, 52, and 38 and the rotating shaft 39. In other words, the pulley 31 is rotated by the drive force of the drive motor 45.

The pulley 32 is an example of a second rotating body and is fixed to the rear end portion of the shaft portion 431 of the drive roll 43A. The pulley 32 has a function of being rotated by the transmitted rotational force and transmitting the rotational force to the drive roll 43A. The pulleys 31 and 32 are toothed pulleys where outer circumferential teeth are formed.

The timing belt 36 is an example of an annular body and is formed in an annular shape. The timing belt 36 is wound around the pulley 31 and the pulley 32 and transmits the rotational force of the pulley 31 to the pulley 32. By the teeth formed on the inner circumference of the timing belt 36 meshing with the teeth formed on the outer circumferences of the pulleys 31 and 32, the timing belt 36 rotates and transmits the rotational force of the pulley 31 to the pulley 32.

The timing belt 36 maintains the state of winding around the pulleys 31 and 32 in both the open state and the closed state of the opening-closing bodies 81 and 82. The state of winding around the pulleys 31 and 32 means a state where the timing belt 36 is wound around the pulleys 31 and 32 without separation. Accordingly, the state includes not only a state where the timing belt 36 is wound around the pulleys 31 and 32 with tension applied to the timing belt 36 but also a state where the timing belt 36 is wound around the pulleys 31 and 32 with the timing belt 36 loose without tension being applied. The timing belt 36 may be wound around the pulleys 31 and 32 without separation from at least the pulleys 31 and 32.

In the present exemplary embodiment, the timing belt 36 is tensioned in the closed state of the opening-closing bodies 81 and 82, and the tension is relaxed in the open state of the opening-closing bodies 81 and 82. In other words, in the present exemplary embodiment, the tension of the timing belt 36 in the open state of the opening-closing bodies 81 and 82 is smaller than the tension of the timing belt 36 in the closed state of the opening-closing bodies 81 and 82.

The interaxial distance of the pulleys 31 and 32 in the open state of the opening-closing bodies 81 and 82 (hereinafter, referred to as an interaxial distance LA (see FIG. 11)) is 92% or more and 105% or less of the interaxial distance in the closed state of the opening-closing bodies 81 and 82 (hereinafter, referred to as an interaxial distance LB (see FIG. 11)), and the interaxial distance LA is preferably, for example, 92% or more and less than 100% of the interaxial distance LB. Specifically, in the present exemplary embodiment, the interaxial distance LA is, for example, 98.7% of the interaxial distance LB.

In the present exemplary embodiment, the interaxial distance LB is, for example, 78.5 mm and the interaxial distance LA is, for example, 77.5 mm. Here, since the interaxial distance LA is shorter than the interaxial distance LB, when the timing belt 36 is bent by, for example, approximately 10% in the open state of the opening-closing bodies 81 and 82, the timing belt 36 becomes more likely to be turned inside out due to curling or caught between surrounding components. In addition, even in a case where the timing belt 36 is bent by 5% or less, the elasticity of the timing belt 36 may cause the timing belt 36 to move in the axial direction of the pulleys 31 and 32 and fall from the pulleys 31 and 32.

On the other hand, in the present exemplary embodiment, regulating portions 32A are provided in both axial end portions of the pulleys 31 and 32 to regulate the timing belt 36 wound around the pulleys 31 and 32 moving in the axial direction of the pulleys 31 and 32 (specifically, the front-rear direction). By regulating the timing belt 36 moving in the axial direction of the pulleys 31 and 32 (specifically, the front-rear direction), the regulating portion 32A suppresses the timing belt 36 falling from the pulleys 31 and 32 and positions the timing belt 36 at the position of winding around the pulleys 31 and 32.

Specifically, the regulating portion 32A protrudes radially outward from, for example, the winding parts of the pulleys 31 and 32 around which the timing belt 36 is wound. In other words, the regulating portion 32A is larger in diameter than the winding part. Although the height of the regulating portion 32A (the radial length of radial protrusion from the winding part) is 2 mm in the present exemplary embodiment, the timing belt 36 is unlikely to be turned inside out or caught between surrounding components at a bending of approximately 5%, and thus a height of 5 mm or less is conceivable with the thickness of the timing belt 36 added to the 5% difference ratio between the interaxial distance LA and the interaxial distance LB.

In FIG. 11, the pulley 32 indicated by a two-dot chain line is the pulley 32 in the closed state of the opening-closing bodies 81 and 82. In addition, FIG. 11 illustrates the regulating portion 32A disposed on one side (specifically, the rear side) of the pulley 32 indicated by a solid line. In addition, the regulating portion 32A provided on the pulley 31 is not illustrated.

In addition, as illustrated in FIG. 11, the interaxial distance LB is equal to or less than the distance between the fulcrum 82S of the opening-closing bodies 81 and 82 and a shaft 32P of the pulley 32 (hereinafter, referred to as a distance represented by virtual line LC (see FIG. 11)). Specifically, in the present exemplary embodiment, the interaxial distance LB is shorter than the distance represented by virtual line LC.

In addition, when viewed in the rotation axis direction of the opening-closing bodies 81 and 82, a shaft 31P of the pulley 31 is disposed on the opening direction side (the arrow RA side in FIG. 11) of the opening-closing bodies 81 and 82 with respect to the virtual line LC connecting the fulcrum 82S and the shaft 32P of the pulley 32 in the closed state of the opening-closing bodies 81 and 82.

Further, when viewed in the rotation axis direction of the opening-closing bodies 81 and 82, the shaft 31P of the pulley 31 is disposed on the closing direction side (the arrow RB side in FIG. 11) of the opening-closing bodies 81 and 82 with respect to a virtual line LD connecting the fulcrum 82S and the shaft 32P of the pulley 32 in the open state of the opening-closing bodies 81 and 82.

In the present exemplary embodiment, when viewed in the rotation axis direction of the opening-closing bodies 81 and 82, the shaft 31P of the pulley 31 is disposed inside the triangular shape surrounded by the virtual line LC, the virtual line LD, and a virtual line LE formed by the trajectory of movement of the shaft 32P of the pulley 32 resulting from the opening and closing of the opening-closing bodies 81 and 82.

Further, the distance between the fulcrum 82S of the opening-closing bodies 81 and 82 and the shaft 31P of the pulley 31 (hereinafter, referred to as a distance LF (see FIG. 11)) is equal to or less than the interaxial distance LB. Specifically, in the present exemplary embodiment, the distance LF is shorter than the interaxial distance LB.

Drive Transmission of Transmission Mechanism 50

As illustrated in FIGS. 3, 4, and 5, in the transmission mechanism 50, the drive force in the forward rotation direction (the arrow 45X direction) from the drive motor 45 is transmitted in the order of the gears 51, 52, 53, 54, and 55, and the gears 51, 52, 53, 54, and 55 rotate in the forward rotation direction (the arrow 45X direction, arrow 52X direction, arrow 53X direction, arrow 54X direction, and arrow 55X direction).

Further, the drive force in the forward rotation direction (the arrow 45X direction) from the drive motor 45 is transmitted from the gear 52 to the shaft portion 411 of the drive roll 41A via the one-way clutch 521, and the drive roll 41A rotates in the forward direction (see the arrow 41X). In this manner, the drive force in the forward rotation direction (the arrow 45X direction) from the drive motor 45 is transmitted from one end side (specifically, the rear end side) with respect to the drive roll 41A.

Further, the drive force in the forward rotation direction (the arrow 45X direction) from the drive motor 45 is transmitted from the gear 55 to the shaft portion 421 of the drive roll 42A, and the drive roll 42A rotates in the forward direction (see the arrow 42X).

Further, the drive force in the forward rotation direction (the arrow 45X direction) from the drive motor 45 is transmitted from the gear 52 to the gear 38, the pulley 31, the timing belt 36, the pulley 32, and the shaft portion 431 of the drive roll 43A in this order, and the drive roll 43A rotates in the forward direction (see the arrow 43X). At this time, the gear 38, the pulley 31, the timing belt 36, and the pulley 32 rotate in the forward rotation direction (the arrow 38X direction, arrow 31X direction, arrow 36X direction, and arrow 32X direction).

When the drive roll 42A rotates in the forward direction, the rotational force in the forward rotation direction of the shaft portion 421 of the drive roll 42A is also transmitted to the pulley 62, the timing belt 66, and the pulley 61, and thus the pulley 62, the timing belt 66, and the pulley 61 rotate in the forward rotation direction (the arrow 62X direction, arrow 66X direction, and arrow 61X direction). However, by the one-way clutch 611 acting, the rotational force is not transmitted from the pulley 61 to the shaft portion 411 of the drive roll 41A.

In addition, as illustrated in FIGS. 7, 8, and 9, in the transmission mechanism 50, the drive force in the reverse rotation direction (the arrow 45Y direction) from the drive motor 45 is transmitted in the order of the gears 51, 52, 53, 54, and 55, and the gears 51, 52, 53, 54, and 55 rotate in the reverse rotation direction (the arrow 45Y direction, arrow 52Y direction, arrow 53Y direction, arrow 54Y direction, and arrow 55Y direction).

Further, the drive force in the reverse rotation direction (the arrow 45Y direction) from the drive motor 45 is transmitted from the gear 55 to the shaft portion 421 of the drive roll 42A, and the drive roll 42A rotates in the reverse direction (see the arrow 42Y).

Further, the drive force in the reverse rotation direction (the arrow 45Y direction) from the drive motor 45 is transmitted from the shaft portion 421 of the drive roll 42A to the pulley 62, the timing belt 66, the pulley 61, the one-way clutch 611, and the shaft portion 411 of the drive roll 41A in this order, and the drive roll 42A rotates in the forward direction. At this time, the pulley 62, the timing belt 66, and the pulley 61 rotate in the reverse rotation direction (the arrow 62Y direction, arrow 66Y direction, and arrow 61Y direction). In this manner, the drive force in the reverse rotation direction (the arrow 45Y direction) from the drive motor 45 is transmitted from the other end side (specifically, the front end side) with respect to the drive roll 41A.

By the one-way clutch 521 acting, the drive force in the reverse rotation direction (the arrow 45Y direction) from the drive motor 45 is not transmitted from the gear 52 to the shaft portion 411 of the drive roll 41A.

Further, the drive force in the reverse rotation direction (the arrow 45Y direction) from the drive motor 45 is transmitted from the gear 52 to the gear 38, the pulley 31, the timing belt 36, the pulley 32, and the shaft portion 431 of the drive roll 43A in this order, and the drive roll 43A rotates in the reverse direction (see the arrow 43Y). At this time, the gear 38, the pulley 31, the timing belt 36, and the pulley 32 rotate in the reverse rotation direction (the arrow 38Y direction, arrow 31Y direction, arrow 36Y direction, and arrow 32Y direction). The recording medium P does not enter the contact region 43S when the drive roll 43A rotates in the reverse direction, and thus the recording medium P does not run in the reverse direction.

Action According to Present Exemplary Embodiment

In the present exemplary embodiment, the timing belt 36 wound around the pulley 31 and the pulley 32 maintains the state of winding around the pulleys 31 and 32 in both the open state and the closed state of the opening-closing bodies 81 and 82.

As a result, the drive transmission path is not divided even when the opening-closing bodies 81 and 82 are opened, and a mechanism for connecting a divided drive transmission path (for example, a gear meshing mechanism) or the like is unnecessary. Accordingly, according to the configuration of the present exemplary embodiment, an increase in the size of the second transporting device 40 and an increase in the size of the image forming apparatus 10 are suppressed as compared with a case where the drive transmission path is divided when the opening-closing bodies 81 and 82 are opened.

In addition, in the present exemplary embodiment, the interaxial distance LA (see FIG. 11) of the pulleys 31 and 32 in the open state of the opening-closing bodies 81 and 82 is 92% or more and 105% or less of the interaxial distance LB (see FIG. 11) in the closed state of the opening-closing bodies 81 and 82.

Accordingly, as compared with a case where the interaxial distance LA is not in the range of 92% or more and 105% or less of the interaxial distance LB, the timing belt 36 is unlikely to be cut or fall and the state where the timing belt 36 is wound is maintained satisfactorily.

In addition, specifically, in the present exemplary embodiment, the interaxial distance LA is 92% or more and less than 100% of the interaxial distance LB.

Accordingly, as compared with a case where the interaxial distance LA is 100% or more of the interaxial distance LB, tension is less likely to act on the timing belt 36 when the opening-closing bodies 81 and 82 are opened and the operating force in opening the opening-closing bodies 81 and 82 is reduced.

In addition, in the present exemplary embodiment, the timing belt 36 is tensioned in the closed state of the opening-closing bodies 81 and 82, and the tension is relaxed in the open state of the opening-closing bodies 81 and 82.

Accordingly, the operating force in opening the opening-closing bodies 81 and 82 is reduced as compared with a case where the tension of the timing belt 36 in the closed state of the opening-closing bodies 81 and 82 is maintained in the open state of the opening-closing bodies 81 and 82.

In addition, in the present exemplary embodiment, the interaxial distance LB is equal to or less than the distance represented by virtual line LC and, when viewed in the rotation axis direction of the opening-closing bodies 81 and 82, the shaft 31P of the pulley 31 is disposed on the opening direction side (the arrow RA side in FIG. 11) of the opening-closing bodies 81 and 82 with respect to the virtual line LC.

As a result, it is possible to easily realize a configuration in which the interaxial distance LA in the open state of the opening-closing portion is shorter than the interaxial distance LB in the open state of the opening-closing portion (that is, a configuration in which the tension of the timing belt 36 is relaxed in the open state of the opening-closing bodies 81 and 82).

In addition, in the present exemplary embodiment, when viewed in the rotation axis direction of the opening-closing bodies 81 and 82, the shaft 31P of the pulley 31 is disposed on the closing direction side (the arrow RB side in FIG. 11) of the opening-closing bodies 81 and 82 with respect to the virtual line LD connecting the fulcrum 82S and the shaft 32P of the pulley 32 in the open state of the opening-closing bodies 81 and 82.

Accordingly, an increase in the size of the second transporting device 40 and an increase in the size of the image forming apparatus 10 are suppressed as compared with a case where the shaft 31P of the pulley 31 is disposed on the opening direction side of the opening-closing bodies 81 and 82 with respect to the virtual line LD when viewed in the rotation axis direction of the opening-closing bodies 81 and 82.

In addition, in the present exemplary embodiment, the distance LF between the fulcrum 82S of the opening-closing bodies 81 and 82 and the shaft 31P of the pulley 31 is equal to or less than the interaxial distance LB.

Accordingly, the rates of change in the interaxial distances LA and LB in the open and closed states of the opening-closing bodies 81 and 82 are smaller than in a case where the distance LF exceeds the interaxial distance LB.

Modification Example of Image Forming Unit 14

The present invention is not limited to the present exemplary embodiment in which the image forming unit 14 that is an intermediate transfer method is used as an example of an image forming unit. As an example of an image forming unit, for example, a direct transfer method may be used in which each of the toner image forming units 20Y to 20K directly forms a toner image on the recording medium P not via the transfer body 24. In an example of an image forming unit, an image forming unit may eject ink to the recording medium P to form an image, and the unit has only to have a function of forming an image on the recording medium P.

Modification Example of Second Transporting Device 40

The present invention is not limited to the present exemplary embodiment in which the second transporting device 40 is provided in the image forming apparatus 10 as an example of a transporting device and a rotating device. An example of a transporting device may be provided in an apparatus having a function other than the function of image formation (for example, image reading, heating, and cutting) or the transporting device may be used alone.

Further, an example of a rotating device may be configured as a device not intended for transport insofar as the device includes a first rotating body capable of forward rotation and a second rotating body capable of forward rotation and reverse rotation.

Modification Example of Recording Medium P

The present invention is not limited to the present exemplary embodiment in which the recording medium P is used as an example of a material to be transported. For example, an example of a material to be transported may be transported for a purpose other than image formation (for example, image reading, heating, and cutting) or being transported may be the only purpose thereof.

Modification Examples of Drive Rolls 41A, 42A, and 43A

The present invention is not limited to the present exemplary embodiment in which the drive roll 43A is used as an example of a transport member. An example of a transport member may be a transport member such as a transport drum and a transport belt. The same applies to the drive rolls 41A and 42A, and a transport member such as a transport drum and a transport belt may be used instead of the drive rolls 41A and 42A.

Modification Examples of Timing Belt 36 and Pulleys 31 and 32

The present invention is not limited to the present exemplary embodiment in which the timing belt 36 is used as an example of an annular body and the pulleys 31 and 32 are used as examples of first and second rotating bodies. An example of an annular body may be, for example, a band body such as a chain and a toothless belt or a member formed in an annular shape. In a case where a chain is used as an example of an annular body, sprockets or the like are used as examples of first and second rotating bodies. In addition, in a case where a band body such as a toothless belt is used as an example of an annular body, a pulley without outer circumferential teeth or the like is used as examples of first and second rotating bodies. In this case, a drive force is transmitted by, for example, friction. As for examples of first and second rotating bodies, drive transmission has only to be possible with an annular body wound.

Modification Example of Transmission Mechanism 50

The present invention is not limited to the present exemplary embodiment in which the transmission mechanism 50 transmits the drive force of the drive motor 45 to the drive rolls 41A, 42A, and 43A, and any mechanism may be used insofar as the drive force of the drive motor 45 is transmitted to at least the drive roll 43A. The transmission mechanism 50 may be configured to transmit the drive force of the drive motor 45 to a configuration portion other than the drive rolls 41A, 42A, and 43A.

Although the gears 51, 52, 53, 54, and 55 are used in the transmission mechanism 50, a transmission member such as a pulley and a timing belt may replace the gears in whole or in part. Although the pulleys 61 and 62 and the timing belt 66 are used in the transmission mechanism 50, a transmission member such as a gear may be used instead.

Modification Examples of Support Frames 47 and 48

The present invention is not limited to the present exemplary embodiment in which the support frames 47 and 48 as examples of a support body are formed in a plate shape in which the front-rear direction is the thickness direction. For example, the support frames 47 and 48 may be formed in a block shape (for example, a cube or a rectangular parallelepiped) or a box shape, and the support frames 47 and 48 are capable of varying in shape. An example of a support body has only to be capable of supporting each configuration portion of the second transporting device 40 including the drive rolls 41A and 42A, the drive motor 45, and the transmission mechanism 50.

Modification Examples of Opening-closing Bodies 81 and 82

The present invention is not limited to the present exemplary embodiment in which the opening-closing bodies 81 and 82 as examples of an opening-closing portion have a function of guiding the recording medium P and are opened and closed so that, for example, clogging with the recording medium P is eliminated. For example, an example of the opening-closing portion may be a cover (that is, a lid) solely for covering a configuration portion of the apparatus or may be opened and closed with respect to a support body such as the support frames 47 and 48.

The present invention is not limited to the present exemplary embodiment in which the opening-closing bodies 81 and 82 as examples of an opening-closing portion are opened and closed by rotating. An example of an opening-closing portion may be, for example, opened and closed by a sliding movement (that is, a linear movement) and has only to be opened and closed with respect to a support body.

The present invention is not limited to the above embodiment, and various modifications, changes, and improvements can be made without departing from the gist thereof. For example, the above modification examples may be combined as appropriate.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A rotating device comprising: an opening-closing portion supported so as to be openable and closable with respect to a support body;

a drive unit provided on the support body;

a first rotating body provided on the support body and rotated by a drive force of the drive unit;

a driven portion provided in the opening-closing portion;

a second rotating body provided in the opening-closing portion, rotated by a transmitted rotational force, and transmitting the rotational force to the driven portion; and an annular body formed in an annular shape, wound around the first rotating body and the second rotating body, maintaining a winding state in both an open state and a closed state of the opening-closing portion, and transmitting the rotational force of the first rotating body to the second rotating body.

2. The rotating device according to claim 1, wherein an interaxial distance between the first rotating body and the second rotating body in the open state of the opening-closing portion is 92% or more and 105% or less of an interaxial distance in the closed state of the opening-closing portion.

3. The rotating device according to claim 2, wherein the interaxial distance between the first rotating body and the second rotating body in the open state of the opening-closing portion is 92% or more and less than 100% of the interaxial distance in the closed state of the opening-closing portion.

4. A transporting device as the rotating device according to claim 3, wherein the driven portion is a transport member transporting a material to be transported by rotation, and the opening-closing portion has a guide portion guiding the material to be transported.

5. An image forming apparatus comprising:

an image forming unit forming an image on a recording medium as the material to be transported; and the transporting device according to claim 4 transporting the recording medium where the image is formed by the image forming unit.

6. A transporting device as the rotating device according to claim 2, wherein the driven portion is a transport member transporting a material to be transported by rotation, and the opening-closing portion has a guide portion guiding the material to be transported.

7. An image forming apparatus comprising:

an image forming unit forming an image on a recording medium as the material to be transported; and the transporting device according to claim 6 transporting the recording medium where the image is formed by the image forming unit.

8. The rotating device according to claim 1, wherein tension is applied to the annular body in the closed state of the opening-closing portion and the tension is relaxed in the open state of the opening-closing portion.

9. A transporting device as the rotating device according to claim 8, wherein the driven portion is a transport member transporting a material to be transported by rotation, and the opening-closing portion has a guide portion guiding the material to be transported.

10. An image forming apparatus comprising:

an image forming unit forming an image on a recording medium as the material to be transported; and the transporting device according to claim 9 transporting the recording medium where the image is formed by the image forming unit.

11. The rotating device according to claim 1, wherein the opening-closing portion is opened and closed by rotating an other end side with one end side as a fulcrum, an interaxial distance between the first rotating body and the second rotating body in the closed state of the opening-closing portion is equal to or less than a distance between the fulcrum and a shaft of the second rotating body, and when viewed in a rotation axis direction of the opening-closing portion, a shaft of the first rotating body is disposed on an opening direction side of the opening-closing portion with respect to a virtual line connecting the fulcrum and the shaft of the second rotating body in the closed state of the opening-closing portion.

12. The rotating device according to claim 11, wherein, when viewed in the rotation axis direction of the opening-closing portion, the shaft of the first rotating body is disposed on a closing direction side of the opening-closing portion with respect to a virtual line connecting the fulcrum and the shaft of the second rotating body in the open state of the opening-closing portion.

13. The rotating device according to claim 12, wherein a distance between the fulcrum and the shaft of the first rotating body is equal to or less than the interaxial distance between the first rotating body and the second rotating body in the closed state of the opening-closing portion.

14. A transporting device as the rotating device according to claim 13, wherein the driven portion is a transport member transporting a material to be transported by rotation, and the opening-closing portion has a guide portion guiding the material to be transported.

15. A transporting device as the rotating device according to claim 12, wherein the driven portion is a transport member transporting a material to be transported by rotation, and the opening-closing portion has a guide portion guiding the material to be transported.

16. The rotating device according to claim 11, wherein a distance between the fulcrum and the shaft of the first rotating body is equal to or less than the interaxial distance between the first rotating body and the second rotating body in the closed state of the opening-closing portion.

17. A transporting device as the rotating device according to claim 16, wherein the driven portion is a transport member transporting a material to be transported by rotation, and the opening-closing portion has a guide portion guiding the material to be transported.

18. A transporting device as the rotating device according to claim 11, wherein the driven portion is a transport member transporting a material to be transported by rotation, and the opening-closing portion has a guide portion guiding the material to be transported.

19. A transporting device as the rotating device according to claim 1, wherein the driven portion is a transport member transporting a material to be transported by rotation, and the opening-closing portion has a guide portion guiding the material to be transported.

20. An image forming apparatus comprising:

an image forming unit forming an image on a recording medium as the material to be transported; and the transporting device according to claim 9 transporting the recording medium where the image is formed by the image forming unit.

* * * * *